US006520846B1

(12) United States Patent
Forbes et al.

(10) Patent No.: US 6,520,846 B1
(45) **Date of Patent: *Feb. 18, 2003**

(54) SANDING AND POLISHING SYSTEMS

(75) Inventors: Stephen Forbes, Hinckley; Stuart F. Brown, Nuneaton; Christopher D. Hayes, Hucknall; Kulbinder Singh Kular, Wolverhampton, all of (GB)

(73) Assignee: 3M Innovative Properties Company, St. Paul, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 628 days.

(21) Appl. No.: 08/549,847

(22) PCT Filed: May 17, 1994

(86) PCT No.: PCT/GB94/01050

§ 371 (c)(1),
(2), (4) Date: Mar. 14, 1996

(87) PCT Pub. No.: WO94/26467

PCT Pub. Date: Nov. 24, 1994

(30) Foreign Application Priority Data

May 17, 1993 (GB) ..... 9310107

(51) Int. Cl.[7] ..... B24B 23/00
(52) U.S. Cl. ..... 451/359; 451/344; 451/449
(58) Field of Search ..... 451/344, 353, 451/359, 449; 62/5

(56) References Cited

U.S. PATENT DOCUMENTS

| | | | | |
|---|---|---|---|---|
| 1,862,135 | A | 7/1932 | Bucy | |
| 1,952,281 | A | 3/1934 | Ranque | 62/170 |
| 2,581,168 | A | 1/1952 | Bramley | 62/136 |
| 3,173,273 | A | 3/1965 | Fulton | 62/5 |
| 3,208,229 | A | 9/1965 | Fulton | 62/5 |
| 4,333,754 | A | 6/1982 | Peter | 62/5 |
| 4,919,232 | A | 4/1990 | Lofton | 184/6.26 |
| 5,088,241 | A | 2/1992 | Lubbering et al. | 51/266 |
| 5,088,242 | A | 2/1992 | Lubbering et al. | 51/266 |

FOREIGN PATENT DOCUMENTS

| | | |
|---|---|---|
| DE | A-3 910 581 | 10/1990 |
| DE | A-3 943 491 | 8/1991 |
| EP | 0 328 963 | 8/1989 |
| EP | 0 332 956 | 9/1989 |
| GB | 1 387 784 | 3/1975 |

OTHER PUBLICATIONS

Abstract of papers presented Dec. 7–8, 1993, at the meeting titled "Finishing & Coating Automotive Plastics", of the Society of Manufacturing Engineers held at Troy, Michigan.

Paper entitled "Cryogenic Polishing of Highly Elastic 2–Component Topcoats" which was presented at an International Congress and Exposition in Detroit, Michigan between Feb. 26 and Mar. 2, 1990.

Extracts from catalogues from Vortex Corporation and Exair Corporation which were available in 1992.

*Primary Examiner*—Eileen P. Morgan
(74) *Attorney, Agent, or Firm*—William L. Huebach

(57) ABSTRACT

An sanding/polishing apparatus which has a motor including a body and a working head which is mounted on the body for sanding/polishing movement relative to the body and to a surface to be treated and includes means for attachment of an abrasive or polishing material to the working head. A feed line is provided in the motor for directing a cold gas flow through the body and working head to the surface to be treated, and a cold gas flow is fed to that feed line through a vortex tube mounted on the body that significantly reduces the temperature of the air delivered to the feed line.

9 Claims, 1 Drawing Sheet

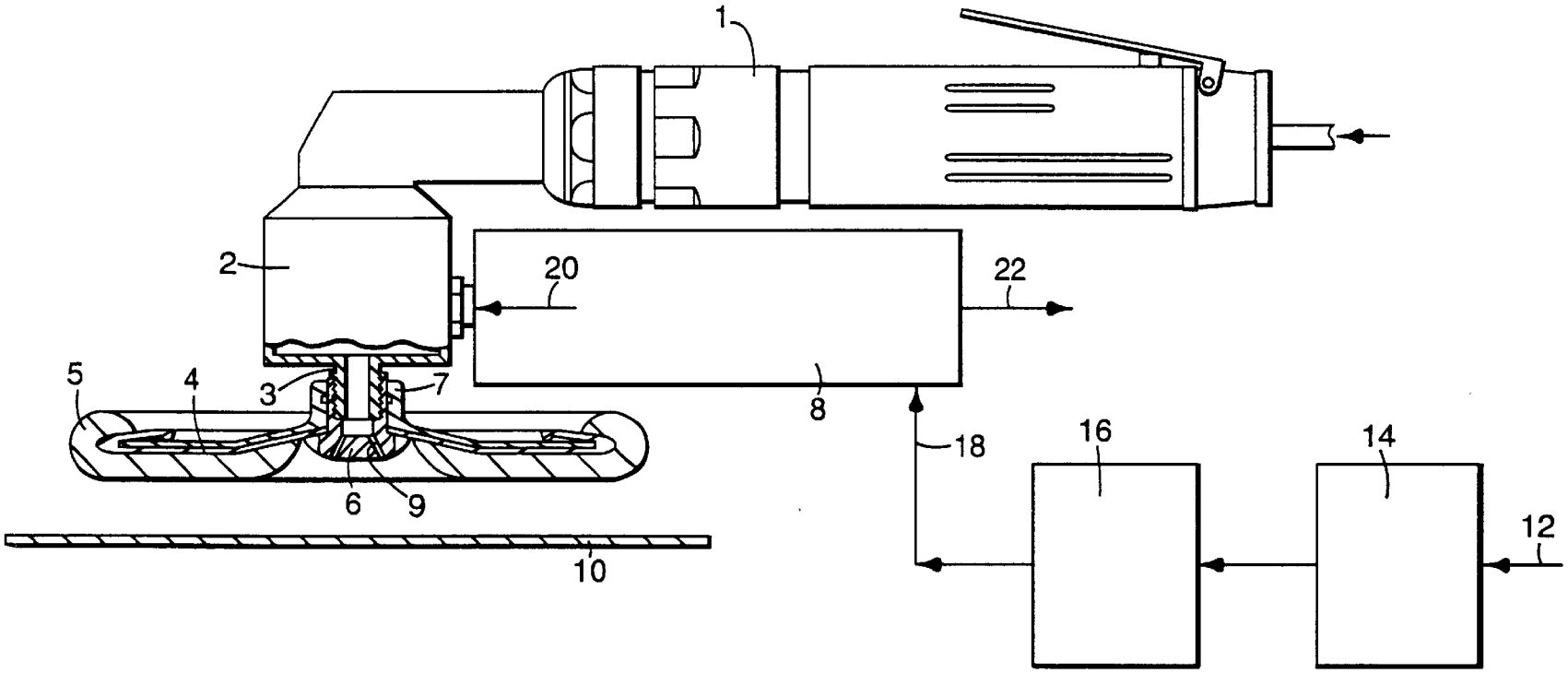
12
14
16
22
18
8
1
20
10
7
9
6
3
2
4
5

SANDING AND POLISHING SYSTEMS

FIELD OF THE INVENTION

This invention relates to sanding and polishing devices and to methods of sanding and polishing at low temperatures, e.g. below −20° C.

BACKGROUND OF THE INVENTION

Coatings employed for exterior automotive plastic parts have to meet criteria which, in many respects, surpass those for the metal substrate. They should be comparable in appearance, chemical/solvent resistance and weather resistance. For plastics, the coatings must meet all of these requirements and additionally cure at temperatures below the heat deformation temperature of the substrate (in some cases less than 200° F.). As well, it has been shown that to retain the low temperature impact resistances of plastics, the total coating system must be flexible. Flexible two-component polyurethane coatings have been proven to satisfy all of these requirement and have, therefore, been the dominant technology employed in Europe for exterior automotive parts for more than ten years and have recently seen success in the U.S. market.

In the automotive industry, it is common practice to correct small imperfections such as those arising from dust particles, by sanding and polishing. Until recently, it was not possible to sand and polish highly flexible two-component polyurethane coatings and achieve the desired original high gloss. This led to the necessity, in most cases, of sanding and recoating the entire part, an operation that reduced the output and productivity of a plastic coating line and increased dramatically the finishing costs.

The advantages of flexible two-component polyurethane coatings have allowed these coatings to penetrate the European automotive plastics markets to more than 90% market share, including such application as bumpers, side trim, wheel covers, and body parts. More recently, they have been used in the American automotive market for thermoplastic bumpers and spoilers and been specified for some plastic wheel covers. The advantages clearly outweighed the disadvantage of non-sandability/polishability.

The elasticity of the film makes polishing difficult. The deeper traces are not polished out, thus giving a resultant lower gloss than the original coating. The net effect of this is the requirement to sand the entire part and recoat or reject the part outright.

Processes of low temperature polishing have been developed to overcome this problem.

In a known touch up process the flawed site is surrounded by a foam ring and the area delimited by the ring is cooled down to a temperature of approximately −40° C. (−40° F.) by means of gaseous nitrogen having a temperature of approximately −160° C. (−265° F.). After this temperature has been reached, the polishing operation is started. As soon as the cooled site has warmed up to a temperature of approximately −10° C. (14° F.), the polishing operation is discontinued and the site is cooled down once again.

This discontinuous process has the disadvantage that it is time consuming and expensive with respect to the necessary equipment. A ring is needed to isolate the flawed site, several cooling phases are necessary and the polishing disc has to be taken out of the ring in order to apply the polishing agent.

U.S. Pat. No. 1,862,135 discloses the rubbing down of varnished surfaces with simultaneous cooling by means of compressed carbon dioxide or other gas.

EP0328963 discloses a process for polishing highly elastic lacquer surfaces, characterized in that the surface to be polished is kept at a temperature of at most +5° C. during polishing by means of a gas with a maximum temperature of −5° C. which is passed over the surface to be polished. The cold gas is obtained from a liquefied gas e.g. liquid nitrogen.

EP0332956 discloses a process for smoothing and/or polishing a fully hardened lacquer coating composed of a type of lacquer possessing a high degree of elasticity, wherein the smoothing or polishing is carried out at temperatures below the ambient temperature, characterized in that firstly that area of the lacquer coating which is to be smoothed and/or polished is cooled to −30 to −50° C. in that it is blasted with cold gas, whereupon this cooled area is smoothed and/or polished. The cold gas is derived from a cryogenic medium, particularly liquid nitrogen or liquid argon.

U.S. Pat. No. 5,088,242 discloses a polishing device having a rotatable polishing disc which is movably mounted relative to the surface being treated, in which a lambskin hood is mounted over the exposed work surface of the polishing disc, a feed line communicating with the area of the lambskin hood, means for feeding a cold gas flow through the feed line and directed in the lambskin hood area during operation of the polishing device, the work surface being entirely disposed toward the surface being treated, the cold gas flow being directed to exit from the entire work surface to be directed at the surface being treated, and the cold gas being selected from cold air and nitrogen and carbon dioxide having a temperature below −20° C.

It was found that when cold gas is fed to the moving tool, at the working site between the tool and the site where the work is to be performed, a good distribution of the cold gas is achieved with simultaneous cooling of the tool and work piece. This cooling makes it possible to immediately work without the need for pre-cooling or intermediate cooling.

In order to achieve the required cold gas the patent states it is advantageous to employ liquefied gas, e.g. liquefied nitrogen having a boiling point of −196° C. or carbon dioxide having a boiling temperature of −79° C. The commercially available Ingersoll Rand cryogenic polishing machine employs liquefied nitrogen as the cooling medium.

One of the disadvantages of the use of liquefied gases, such as liquefied nitrogen, in such polishing apparatus, is that the capital cost of the equipment is high as it requires electronic control and the running cost is also high as liquefied nitrogen is expensive.

SUMMARY OF THE INVENTION

The present invention provides an alternative apparatus capable of polishing at low temperatures.

Therefore according to one aspect of the present invention, there is provided apparatus for sanding or polishing comprising:

- a working head which is mounted for sanding/polishing movement relative to the surface to be treated and includes means for attachment of an abrasive or polishing material,
- a feed line for directing a cold gas flow to the surface to be treated, and
- means for feeding a cold gas flow to the feed line, characterized in that said means for feeding a cold gas flow comprises a compressed gas line having a vortex tube.

It has been found that the use of a vortex tube provides a simple, effective and economical method of delivering cold gas to the surface to be treated and head of a sanding or polishing apparatus. By using a water filter and chiller unit in series before the vortex tube it is readily possible to deliver air at −50° C. to the surface being treated allowing high quality finishing of two component paint coatings on plastic substrates.

The feed line may be separate from the head but is preferably incorporated into the apparatus to deliver cold gas to the head e.g. through one or more openings on the working surface of the head.

A vortex tube converts ordinary compressed air into two airstreams, one hot and one cold. With no moving parts, no electricity, and no refrigerant, a vortex tube can produce refrigeration up to 6000 BTUH or temperatures to −50° F. using only filtered factory compressed air at 100 PSIG. A control valve in the hot air exhaust adjusts temperatures, flows and refrigeration over a wide range.

Compressed air enters a tangentially drilled stationary generator which forces the air to spin down the long tube's inner walls towards the hot air control valve, achieving sonic speed up to 1,000,000 RPM.

A proportion of this air, now at atmospheric pressure exits through the needle valve at the hot air exhaust. The remaining air is forced back through the center of the sonic velocity airstream where, still spinning, it moves at a slower speed, causing a simple heat exchange to take place. The inner, slower moving air column gives up heat to the outer, faster moving air column. When the slower inner air column exits through the center of the stationary generator and out the cold exhaust, it has reached an extremely low temperature.

Vortex tubes are the subject of a number of patents including U.S. Pat. Nos. 3,208,229 and 4,333,754. Vortex tubes are commercially available from Vortec Corporation and Meech Exair. Vortex tubes have found utility in numerous applications including cooling machining operations, setting solders and adhesives, dehumidifying gas samples, cooling mold tooling, cooling electronic control cabinets, temperature cycle thermostats, instruments and electronics, cooling workers in protective helmets, hoods and suits, testing automobile temperature sensors and chokes, and cooling industrial sewing needles.

Heretofore, there has been no suggestion of the use of vortex tubes to provide cold gas for sanding and polishing applications.

Whilst a vortex tube can simply be inserted in a compressed air line to provide cold gas it is preferable to utilize a water filter prior to the vortex tube to avoid problems of icing. Also, the use of a chiller to reduce the inlet temperature to the vortex tube, e.g. to about +3° C., facilitates the production of the cold gas stream.

Suitable water filters include desiccant dryers. A preferred dryer is commercially available from HPC Engineering plc, Victoria Gardens, Burgess Hill, West Sussex, United Kingdom under the trade name Midi DD25. The dryer is conveniently fitted with an inlet filter type AA-D0025G to protect the desiccant against contamination and an outlet filter type AR-0025G to remove desiccant dust from the dried air.

The water free air may then be passed through a refrigerant drier, e.g. commercially available from APC Engineer plc under the trade name SRDE-39 or a refrigerant drier commercially available from Denco Limited, Hereford, United Kingdom under the trade name Denco SN 12 which uses R502 refrigerant. The refrigerant drier cools the air stream to about +3° C.

Thereafter the air is passed through a vortex tube, e.g. Model Number 208-11-H or 208-15-H, commercially available from Vortec Corporation, Witney, Oxon, OX8 5DP, United Kingdom. Other vortex tubes, e.g. those available under the registered trade mark "EXAIR" from Meech Exair may be used.

It has been found that by delivering air at 60 to 70 psi and room temperature through such a system will result in air leaving the vortex tube at about 15 psi at a temperature of about −50° C.

The cold gas stream may be directed on the work surface by a nozzle, etc., but preferably is directed to the head of the sanding or polishing apparatus. The vortex tube is preferably positioned close to the cold gas outlet since longer line lengths would require insulation to maintain the cold temperature. The vortex tube may conveniently be incorporated into the sanding or polishing apparatus, e.g. in or adjacent the handle of the apparatus.

It has been found that the apparatus of the invention satisfactorily polishes "soft paint" finishes, e.g., polyurethane systems, on plastic components using conventional compounds e.g., FINESSE-IT, commercially available from Minnesota Mining and Manufacturing Company, St. Paul, Minn.

In addition it has been found that the application of cold gas to the work surface during general sanding operations, both with soft paint and other paint finishes, including water based paints, provides unexpected advantages. In particular it has been found that the loading of the abrasive material is substantially reduced allowing more efficient sanding.

Therefore according to a further aspect of the invention there is provided a method of sanding a surface in which a cold gas stream having a temperature of not more than −20° C. is directed at the surface being sanded during the sanding operation.

BRIEF DESCRIPTION OF THE DRAWING

The invention will now be described with reference to the accompanying drawing which represents a diagram of a polishing application in accordance with the invention.

The polishing apparatus illustrated is a modification of that disclosed in U.S. Pat. No. 5,088,242 which is commercially available from Ingersoll Rand, Model CR70-3LJ-2300.

A compressed air motor (1) is equipped with an angular head (2) to whose drive shaft (3) a polishing disc (4) having a lambskin hood (5) is attached. This attachment is accomplished by a nut (6) that rests upon the hub (7). The cold gas feed enters the head via a vortex tube (8). From there, the cold gas passes through hollow shaft (3) and reaches the working area of the polishing disc via the boreholes (9). The rotating lambskin hood (5) functions as a unilaterally open centrifugal pump due to the scooping effect and gas friction. As a result, gas is constantly conveyed out of the working area and replaced by new cold gas. Surprisingly, this effect leads to a permanent cooling of the polishing disc, thus making it possible to initiate the polishing operation immediately, without first cooling the work piece (10).

The cooling effect is further promoted by positioning the polishing disc diagonally to the surface of the work piece (10) during polishing. As a result, the open centrifugal pump closely resembles a closed centrifugal pump with an intensified adhesion effect of the cold gas in the working area. In this manner, the surface to be polished and the entire polishing disc are constantly cooled. In this process, the cooling is completely sufficient and there is no need to interrupt the polishing operation in the order to once again cool the work piece.

The cold gas is derived from a source of compressed air (12) e.g. at 80 psi which passes through a water filter or drier (14) and thereafter through a chiller unit (16) which reduces the temperature to about +3° C. The compressed air is passed to the inlet (18) of the vortex tube (8) where it is divided into a cold gas stream (20) which passes into the head (2) of the apparatus at a temperature of about −38° C. at about 15 psi and a hot gas stream (22) which is diverted away from the work surface (10) and may optionally be utilized, e.g. as a hand warmer for the operator.

The apparatus may be fitted with a valve to cut off the air supply to the vortex tube when the apparatus is not in use in order to prevent freezing of the polishing head. The valve may be linked to the switch controlling the drive motor.

DESCRIPTION OF THE PREFERRED EMBODIMENT

It will be appreciated that it is not necessary to provide a separate water filter and chiller for each polishing apparatus. By selection of suitable equipment a single water filter and chiller may serve two or more polishing units each equipped with a vortex tube.

The apparatus and method of the invention may be used to abrade or polish a variety of workpieces including painted surfaces, plastic, metals, ceramics, glass, wood, woodline material, metal/ceramic composites, stones and the like. The workpiece may be flat or contoured.

The apparatus may readily be modified for sanding purposes by replacing the disc (4) and hood (5) by a sanding disc and abrasive material. The disc may have a series of channels and apertures in communication with the hollow shaft (3) to deliver cold gas to the work surface (10). The channels may be arranged in the sanding disc in a similar manner to those employed for dust extraction purposes.

What is claimed is:

1. An apparatus for sanding or polishing a surface comprising:

a motor including a body and a working head which is mounted on said body for sanding/polishing movement relative to said body and to the surface to be treated, said working head including means for attachment of an abrasive or polishing material to said working head, feed line means for directing a cold gas flow through said body and working head to the surface to be treated, and means for feeding a cold gas flow to the feed line means comprising a compressed gas line, and a vortex tube mounted on said body, said vortex tube having an outlet opening communicating with said feed line means, and having an inlet end connected to said compressed gas line.

2. An apparatus as claimed in claim 1 in which the compressed gas line has an inlet end opposite said vortex tube, and said means for feeding a cold gas flow to the feed line means additionally comprises a water filter and chiller unit in series with the vortex tube at the inlet end of said compressed gas line.

3. An apparatus as claimed in claim 1 in which the means for feeding a cold gas flow feeds a cold gas stream at a temperature of not more than −20° C. to said feed line means.

4. An apparatus as claimed in claim 1 in which the means for feeding a cold gas flow feeds a cold gas stream at a temperature of about −38° C. to said feed line means.

5. An apparatus as claimed in claim 1 in which the means for feeding a cold gas flow feeds a cold gas stream at a temperature of about −50° C. to said feed line means.

6. An apparatus for sanding or polishing a surface comprising:

a motor including a body and a working head which is mounted on said body for sanding/polishing movement relative to said body and to the surface to be treated, said working head including means for attachment of an abrasive or polishing material to said working head, feed line means for directing a cold gas flow to the surface to be treated, and means for feeding a cold gas flow to the feed line means comprising a vortex tube adjacent said working head and a compressed gas line, said vortex tube having an outlet opening communicating with said feed line means, and having an inlet end connected to said compressed gas line, the compressed gas line having an inlet end opposite said vortex tube, and said means for feeding a cold gas flow to the feed line means additionally comprising a water filter and chiller unit in series with the vortex tube at the inlet end of said compressed gas line.

7. An apparatus as claimed in claim 6 in which the means for feeding a cold gas flow feeds a cold gas stream at a temperature of not more than −20° C. to said feed line means.

8. An apparatus as claimed in claim 6 in which the means for feeding a cold gas flow feeds a cold gas stream at a temperature of about −38° C. to said feed line means.

9. An apparatus as claimed in claim 6 in which the means for feeding a cold gas flow feeds a cold gas stream at a temperature of about −50° C. to said feed line means.

* * * * *